US006983991B2

(12) United States Patent
Strona

(10) Patent No.: US 6,983,991 B2
(45) Date of Patent: Jan. 10, 2006

(54) REMOVABLE ANATOMIC SEAT

(76) Inventor: Giancarlo Strona, Frazione Bolla N. 5Bis, I-13823 Strona Biellese Biella (IT)

( * ) Notice: Subject to any disclaimer, the term of this patent is extended or adjusted under 35 U.S.C. 154(b) by 0 days.

(21) Appl. No.: 10/489,885

(22) PCT Filed: Sep. 25, 2002

(86) PCT No.: PCT/EP02/10747

§ 371 (c)(1),
(2), (4) Date: Mar. 17, 2004

(87) PCT Pub. No.: WO03/028510

PCT Pub. Date: Apr. 10, 2003

(65) Prior Publication Data

US 2005/0067869 A1 Mar. 31, 2005

(30) Foreign Application Priority Data

Oct. 1, 2001 (IT) ..... MI2001A2036

(51) Int. Cl.
*A61G 15/00* (2006.01)

(52) U.S. Cl. ..... 297/330; 297/313; 297/452.21; 297/452.23; 297/452.25; 297/452.26; 297/DIG. 10

(58) Field of Classification Search ..... 297/330, 297/313, DIG. 10, 452.21, 452.22, 452.23, 297/452.25, 452.26
See application file for complete search history.

(56) References Cited

U.S. PATENT DOCUMENTS

| | | | | |
|---|---|---|---|---|
| 731,778 | A * | 6/1903 | Holtzmuller et al. | 297/452.25 |
| 800,458 | A * | 9/1905 | Martin | 297/452.25 |
| 1,004,589 | A * | 10/1911 | Pridmore | 297/452.25 |
| 1,188,453 | A * | 6/1916 | Johnson et al. | 297/452.22 |
| 2,208,745 | A * | 7/1940 | Bloomberg | 297/452.25 X |
| 2,380,102 | A * | 7/1945 | Farmer | 297/452.22 X |
| 2,825,393 | A * | 3/1958 | Warburton et al. | 297/452.22 X |
| 3,250,569 | A * | 5/1966 | Gaffney | 297/330 |
| 4,588,229 | A * | 5/1986 | Jay | 297/452.23 X |
| 4,607,882 | A * | 8/1986 | Opsvik | 297/452.23 X |
| 4,726,624 | A * | 2/1988 | Jay | 297/452.23 X |
| 5,018,790 | A * | 5/1991 | Jay | 297/452.26 |
| 5,082,327 | A | 1/1992 | Crisp | 297/313 |
| 5,123,699 | A * | 6/1992 | Warburton | 297/452.26 X |
| 5,333,931 | A * | 8/1994 | Weddendorf | 297/330 X |
| 5,346,280 | A * | 9/1994 | Deumite | 297/330 |
| 5,378,045 | A * | 1/1995 | Siekman et al. | 297/452.25 |
| 5,395,162 | A * | 3/1995 | Jay et al. | 297/452.25 |
| 5,429,852 | A * | 7/1995 | Quinn | 297/452.26 X |
| 5,522,106 | A * | 6/1996 | Harrison et al. | 297/452.25 X |
| 5,681,092 | A * | 10/1997 | Hanson et al. | 297/452.21 X |
| 5,845,352 | A | 12/1998 | Matsler et al. | |
| 5,918,936 | A | 7/1999 | Murphy | 297/313 |

(Continued)

FOREIGN PATENT DOCUMENTS

| | | |
|---|---|---|
| DE | 23 34 400 | 1/1975 |

(Continued)

*Primary Examiner*—Rodney B. White

(74) *Attorney, Agent, or Firm*—Hedman & Costigan, P.C.

(57) ABSTRACT

A removable anatomic seat (10) comprises a support structure (22) for an anatomic seating recess (20) for a user, where the structure is rested above a piece of furniture (14) and where the recess (20) is hinged at least one end (at 24) to the structure (22), being foreseen lifting elements (30, 32, 34, 36, 38, 40, 42, 44) to tilt the recess (20) with respect to the structure (22).

8 Claims, 3 Drawing Sheets

U.S. PATENT DOCUMENTS 6,142,573 A * 11/2000 Harding et al. ..... 297/452.25
6,625,830 B2 * 9/2003 Lampel ..... 297/452.26 X
6,637,818 B2 * 10/2003 Williams ..... 297/330
6,702,383 B2 * 3/2004 Newman et al. ..... 297/330 X
6,709,052 B2 * 3/2004 Jalkanen ..... 297/452.21 X
2003/0038518 A1 * 2/2003 WIlliams ..... 297/330
2003/0090135 A1 * 5/2003 Newman et al. ..... 297/330 X
2004/0160111 A1 * 8/2004 Koffler ..... 297/452.25

FOREIGN PATENT DOCUMENTS

DE 4300602 A1 * 7/1994
DE 200 20 217 3/2001
GB 2193886 A * 2/1988

* cited by examiner

REMOVABLE ANATOMIC SEAT

The present invention refers to a removable anatomic seat.

In the field of seats, the ergonomic characteristics have an ever greater importance in their design. These aspects are especially accentuated in the case of seats intended for users who have to remain seated for a long time.

These activities which involve sitting for long periods bring risks as far as backache and other muscular-skeletal difficulties are concerned.

If the posture taken up on the seat is not physiologically correct, there is an increase in pressure on the disks of the spinal cord with respect to standing position, due to the fact that the pressure is associated with a prolonged static load on the lumbar column.

The most frequent symptoms which come from this are: lumbago, cervical vertebra ache and pectoral girdle pains.

Therefore, some seats are equipped with adjustment devices which can adapt to the morphology of the user, in particular as far as the position of the seat and backrest are concerned.

The position of the pelvis is essential in determining the posture of the rest of the body.

If the pelvis is tilted forwards it is easier to keep the correct head-trunk-pelvis alignment.

In the field special seats do exist, realised for the purpose of allowing the user to have the correct back position, which must be as close as possible to upright position.

Generally, they foresee a seat tilted forwards and devices for supporting the lower part of the user's legs, for example for knees.

The tilted seat helps a correct posture of the back to be taken up. Moreover, the support devices allow part of the weight which would weigh down upon the spinal cord to be discharged onto the lower limbs of the user. Nevertheless, such seats are quite heavy, and therefore are difficult to transport.

Moreover, the adjustment of the inclination of the seat is not very accurate, and the lower limbs are forced to remain in a predetermined position. U.S Pat. No. 5,918,936 discloses a removable anatomic seat according to the preamble of claim 1.

The purpose of the present invention is therefore that of avoiding the drawbacks mentioned previously and in particular that of realising a removable anatomic seat which allows to improve the ergonomics of any chair. Another purpose of the present invention is that of realising a removable anatomic seat which allows an accurate adjustment of the best inclination for the morphological characteristics of the user.

Another purpose of the present invention is that of realising a removable anatomic seat which is particularly reliable, simple, and functional at a relatively low cost.

These and other purposes according to the present invention are achieved by realising a removable anatomic seat as outlined in claim 1.

Further characteristics are foreseen in the subsequent claims.

The characteristics and advantages of a removable anatomic seat according to the present invention shall become clearer from the following description, given as an example and not for limiting purposes, referring to the attached schematic drawings in which.

Figure 2:
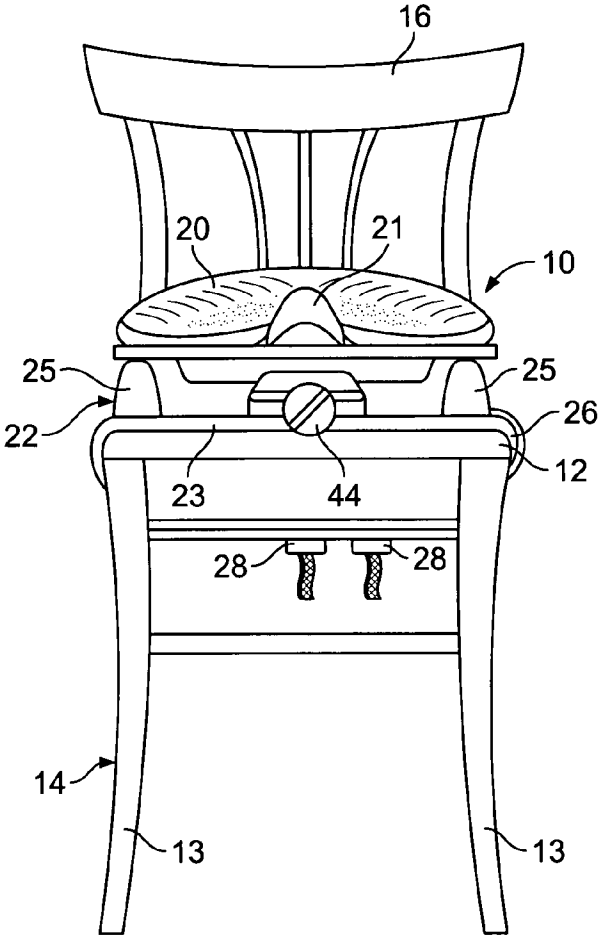
FIG. 2 is a front view of FIG. 1.

It should be noted that the following description, regarding a preferred embodiment, refers to an application of the removable anatomic seat, according to the invention, on a chair.

Alternatively and neither more nor less advantageously, the removable anatomic seat, object of the present invention, can also be used for other types of furniture, such as armchairs and stools.

With reference to the figures, a removable anatomic seat, wholly indicated with 10, is shown, which is rested on top of a horizontal seat 12 of a chair 14, equipped at the rear with a backrest 16.

In the illustrated example, according to the present invention, the anatomic seat 10 comprises an anatomic seating recess 20, supported by a structure 22.

The anatomic recess 20 is shaped to allow comfortable seating to the user. It is equipped with an element protruding upwards or raised portion 21, in a front and central position of the recess 20 itself.

In the example shown in the figures, the structure 22 comprises a base 23, for example four-sided, which covers the seat 12 of then chair 14.

Four supports 25, for example, are arranged on the base 23 in correspondence with four legs 13 of the chair 14. The two front supports 25, which are on an opposite side to the backrest 16 of the chair 14, are rotatably connected to the seating recess 20 at 24.

Moreover, the structure 22 is fixed to the chair 14 through stable positioning elements such as belts 26, generally in a closed loop with buckles 28 below the seat 12 of the chair 14.

The seating recess 20 can be tilted with respect to a horizontal support thereof on the structure 22, through lifting elements.

Such a lifting takes place with the displacement of a shaft 30, rotatably connected centrally at a lower end 32 to the anatomic recess 20, and more precisely in a central zone or in any case not close to the front supports 25. Such a connection can advantageously be quickly removable, for example through a pin.

The shaft 30 is rotatably connected at an opposite end 34 to a small block 36. Such a connection can advantageously be quickly removable, for example through a pin.

Figure 5:
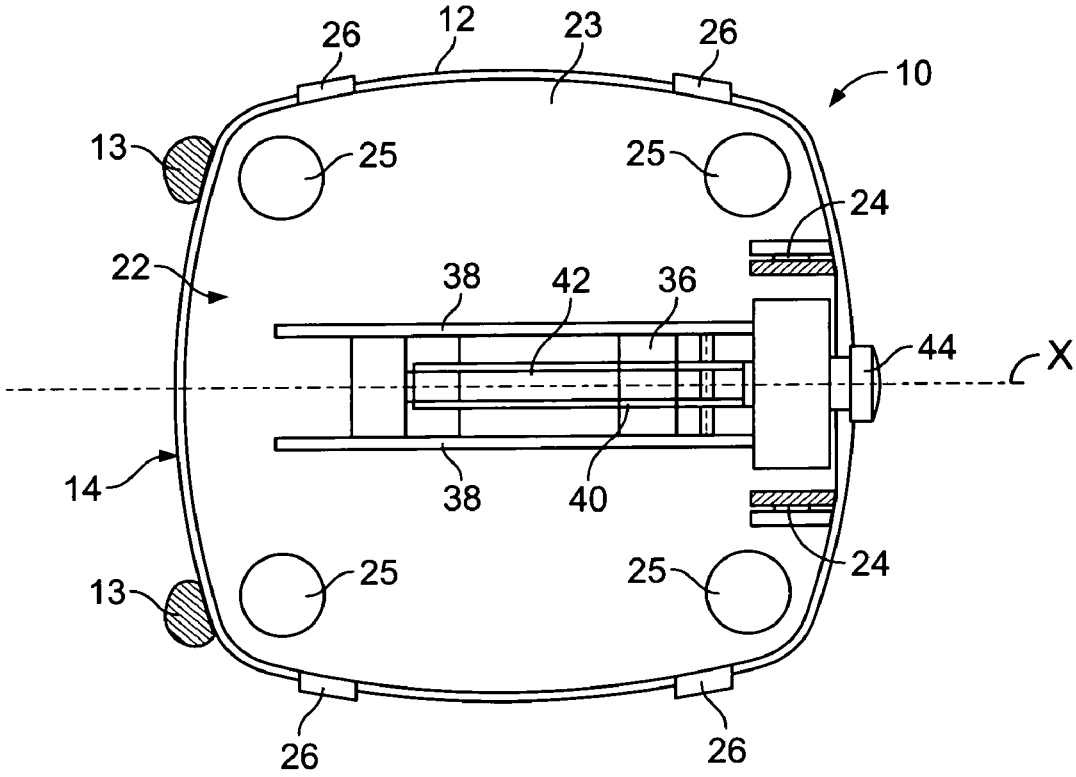
FIG. 5 is a plan section view from above of the chair equipped with the removable anatomic seat of FIG. 1, taken according to the line V—V of FIG. 1, in which an anatomic seating recess has been removed.

As can be seen in FIG. 5, such a small block 36 can slide on a guide 38, inside the structure 22, and which extends according to a direction X perpendicular to the backrest 16. Moreover, the small block 36 has a threaded bore 40, realised in the direction X, matching a screwing 42, also arranged along the direction X. The screw 42 is equipped with a handle 44 arranged at the front of the anatomic seat 10.

The operation of the removable anatomic seat according to the invention is clear from that which is described above with reference to the figures, and in brief is the following.

The base 23 of the structure 22 is fixed to the seat 12 of the chair 14.

The seating recess 20, hinged at 24 to the two front supports 25, is rested horizontally on the two rear supports 25.

Figure 1:
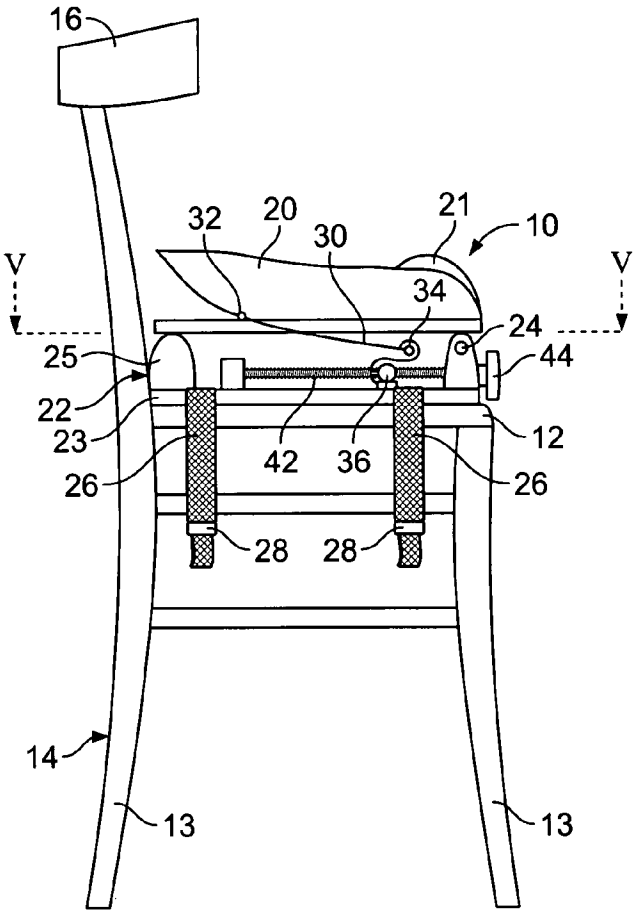
FIG. 1 is a side view of a chair equipped with a removable anatomic seat, according to the present invention, in a horizontal position.
Figure 4:
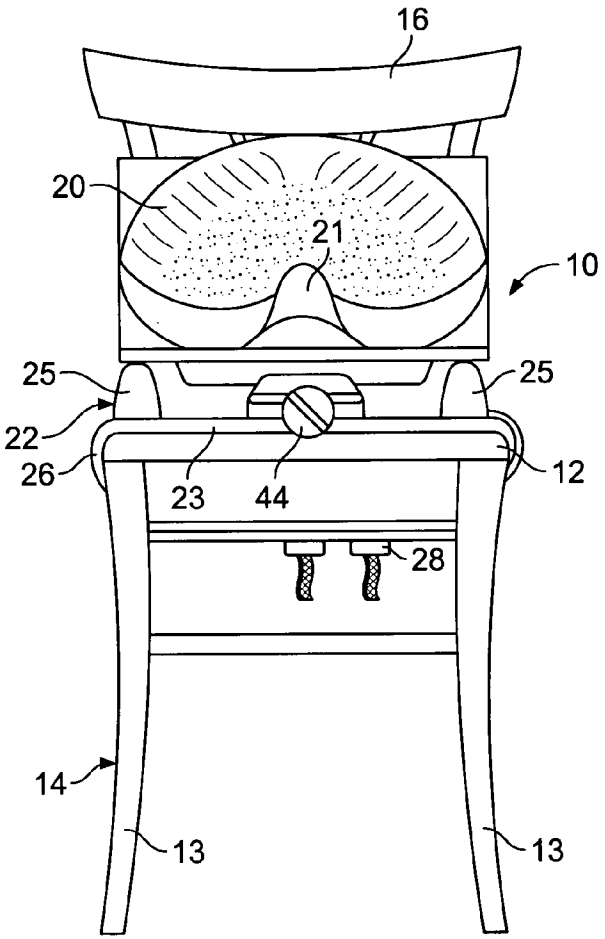
FIG. 4 is a front view of FIG. 3.
Figure 3:
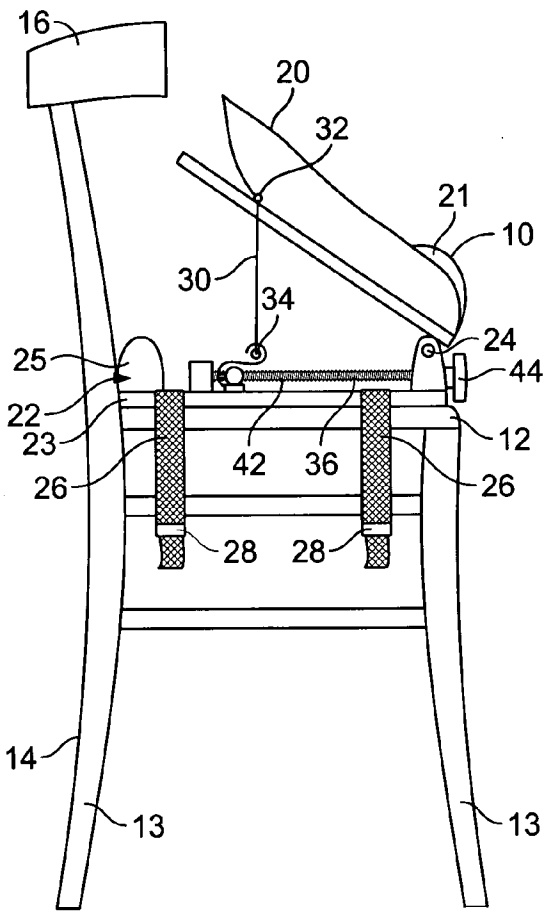
FIG. 3 is a side view of the chair equipped with the removable anatomic seat of FIG. 1, where the seat exhibits a tilted position.

As can be seen in FIG. 1, the small block 36 is arranged on one side near to the two front supports 25, so that the shaft 30, connected to the small block 36 itself, is in a substantially horizontal position. By rotating the handle 44 of the screw 42, the small block 36 is displaced towards the backrest 16. In this way the shaft 30 pushes the anatomic recess 20 upwards, tilting it with respect to a horizontal plane.

Advantageously, an inclination of about 30° is reached, with the possibility of practically infinite variations in inclination. For example, the inclination can be progressively varied by rotating the handle 44 day by day.

The seating recess 20 has high friction coefficient zones at the top to limit the user slipping forwards. Moreover, the suitably upholstered central raised portion 21 is also used for the same purpose.

The front and side edges of the seating recess 20 are suitably sanded.

The removable connection realised between small block 36 and shaft 30 and/or between shaft 30 and recess 20 allows passage at any time from the optimal inclination which has been achieved to the horizontal position, or vice-versa, precisely by simply removing, or reapplying, respectively, the connection between shaft 30 and small block 36 and/or recess 20.

From the description which has been carried out the characteristics of the removable anatomic seat object of the present invention are clear, just as the relative advantages are clear, amongst which we recall:

- simple and reliable use;
- small size and weight;
- adaptability to practically all conventional seats;
- ease of transportation;
- possibility of a very accurate adjustment of the inclination;
- ability to keep the obtained inclination, even after possible dismounting;
- possibility of immediately passing from the position obtained to horizontal position, and vice-versa, to suit the needs of the user;
- freedom of movement for the lower limbs;
- low costs, with respect to the prior art, in relation to the advantages obtained.

Finally, it is clear that the removable anatomic seat thus conceived is susceptible to numerous modifications and variants, all of which are covered by the invention; moreover, all of the details can be replaced by technically equivalent elements. In practice, the materials used, as well as the shapes and sizes, can be whatever according to the technical requirements.

The scope of protection of the invention is therefore set out by the attached claims.

What is claimed is:

1. Removable anatomic seat (10) comprising a support structure (22) for an anatomic seating recess (20) for a user, where said structure is rested above a piece of furniture (14) and where said recess (20) is hinged at least one end (24) to said structure (22), said seat (10) including lifting elements (30, 32, 34, 36, 38, 40, 42, 44) to tilt the recess (20) with respect to the structure (22) wherein said lifting elements (30, 32, 34, 36, 38, 40, 42, 44) comprise a shaft (30) rotatably connected at its lower end (32) to the recess (20), and at its opposite end (34) to a small block (36) which can slide on a guide (38), integral with the structure (22) which is fixed on top of said piece of furniture (14) through stable positioning elements (26, 28) said stable positioning elements (26, 28) comprising belts (26) and buckles (28).

2. Seat (10) according to claim 1, wherein a connection between shaft (30) and small block (36) and between shaft (30) and recess (20) wherein said connection is adapted to be removable.

3. Seat (10) according to claim 1 or 2, wherein a guide (38) extends according to a direction (X) perpendicular to the axis of a hinge (24) between structure (22) and recess (20), and in that said small block (36) has a threaded bore (40), that is provided in direction (X) as and matching a screw (42), also arranged along the same direction (X) and equipped with a handle (44) to ease its rotation.

4. Seat (10) according to claim 1, wherein said piece of furniture (14) is a chair (14) equipped with a horizontal seat (12), four legs (13) and a backrest (16).

5. Seat (10) according to claim 4, wherein said structure (22) comprises a four-sided base (23) which covers said seat (12) of the chair (14), on said base (23) being arranged four supports (25) in correspondence with said legs (13) of the chair (14), where the two front supports (25), which are on the opposite side to the backrest (16) of the chair (14), are rotatably connected (t 24) to said seating recess (20).

6. Seat (10) according to claim 1, wherein said recess (20) is equipped with an upwardly protruding element or raised portion (21), in a central transversal position of the recess (20).

7. Seat (10) according to claim 6, wherein said raised portion (21) is upholstered.

8. Seat (10) according to claim 1, wherein said recess (20) at the top has high friction coefficient zones, to limit the slipping forward of the user.

* * * * *